US006405011B1

(12) United States Patent
Wang et al.

(10) Patent No.: US 6,405,011 B1
(45) Date of Patent: Jun. 11, 2002

(54) DEVELOPER REPLENISHING CONTAINER

(76) Inventors: Jui-Chi Wang; Robin Hsu; Ya-Li Huang; Kuan-Tung Li, all of No.498, Sec 1, Yung-Shing Rd., Wu-Chi Town, Taichung County (TW)

( * ) Notice: Subject to any disclaimer, the term of this patent is extended or adjusted under 35 U.S.C. 154(b) by 0 days.

(21) Appl. No.: 09/880,234

(22) Filed: Jun. 12, 2001

(51) Int. Cl.[7] ..... G03G 15/08
(52) U.S. Cl. ..... 399/262; 222/DIG. 1; D18/43
(58) Field of Search ..... 399/262, 260, 399/258; D18/43; 222/DIG. 1; 215/42

(56) References Cited

U.S. PATENT DOCUMENTS 4,060,105 A * 11/1977 Feldeisen et al. .. 222/DIG. 1 X
5,794,108 A * 8/1998 Yoshizawa et al. ..... 399/262
5,867,757 A * 2/1999 Okazaki et al. ..... 399/262
D431,595 S * 10/2000 Wang et al. ..... D18/43 X
6,188,859 B1 * 2/2001 Wang et al. ..... 399/262
6,229,977 B1 * 5/2001 Wang et al. ..... 399/262

FOREIGN PATENT DOCUMENTS

JP 07-181788 * 7/1995

* cited by examiner

*Primary Examiner*—Sophia S. Chen
(74) *Attorney, Agent, or Firm*—Pro-Techtor International Services

(57) ABSTRACT

A developer-replenishing container having a cylindrical container body holding a developer, a front bottleneck for output of the developer, a tubular front extension axially connected between the container body and the front bottleneck, smooth developer guide wall portions and oblique developer guide wall portions alternatively arranged in a spiral series inside the container body and the tubular front extension and adapted to guide the developer toward the front bottleneck without causing a laminar flow.

12 Claims, 4 Drawing Sheets

DEVELOPER REPLENISHING CONTAINER

CROSS-REFERENCE TO RELATED APPLICATION

The present invention relates to a developer-replenishing container for use with an electrophotographic image forming apparatus, and more particularly to such a developer-replenishing container, which enables the developer to be smoothly and evenly supplied without causing a laminar flow when rotated.

A variety of developer-replenishing containers have been disclosed for use with an electrophotographic image forming apparatus. U.S. Pat. No. 6,188,859 shows a developer-replenishing container for this purpose. According to this design, the developer-replenishing container comprises a cylindrical container body A having a tapered front portion A1 terminating in a developer output port C and a spiral guide flange B. The tapered front portion A1 comprises a spiral guide flange B1 defining a spiral guide way B2 adapted to guide the developer from the container body A toward the developer output port C. Because the spiral guide way B2 transversely slopes in one direction B21, the output flow rate of the developer is gradually reduced following the reducing of the amount of the developer left in the container body A.

SUMMARY OF THE INVENTION

The present invention has been accomplished to provide a developer replenishing container, which eliminates the aforesaid problem. It is the main object of the present invention to provide a developer-replenishing container, which outputs the developer smoothly and evenly at a constant flow rate when rotated in the electrophotographic image forming apparatus. According to the present invention, the developer-replenishing container comprises cylindrical container body holding a developer and a tubular front extension axially forwardly extended from the cylindrical container body and terminating in a front bottleneck for output of the developer, the container body comprising longitudinal series of smooth developer guide wall portions symmetrically disposed at two sides and a plurality of oblique developer guide wall portions respectively connected between the smooth developer guide wall portions of the tubular container body and adapted to guide the developer from the cylindrical container body to the tubular front extension, the tubular front extension comprising smooth developer guide wall portions symmetrically disposed at two sides and a plurality of oblique developer guide wall portions respectively connected between the smooth developer guide wall portions of the tubular front extension and adapted to guide the developer from the container body toward the front bottleneck.

DETAILED DESCRIPTION OF THE PREFERRED EMBODIMENT

Figure 1:
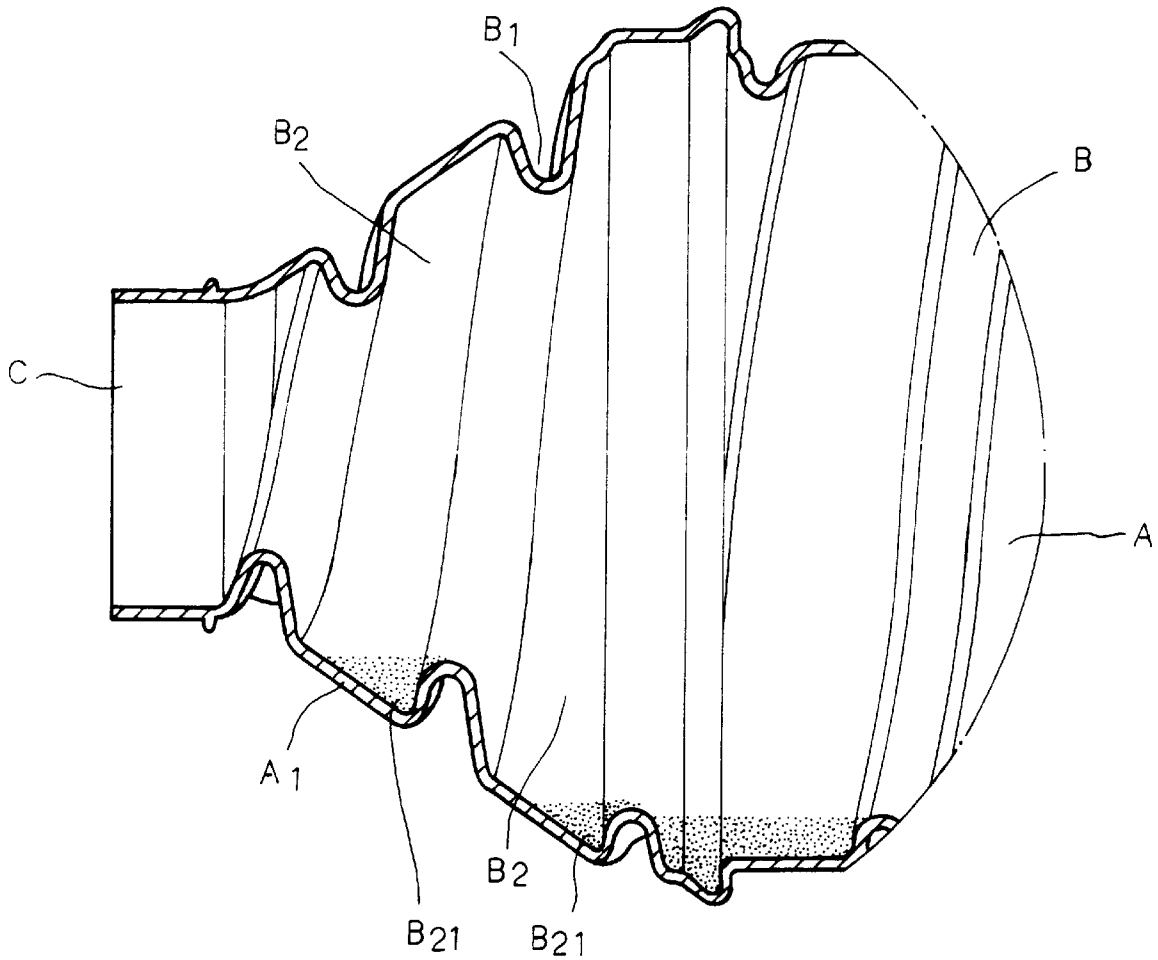
FIG. 1 (PRIOR ART)
FIG. 1 is a sectional view of a developer-replenishing container according to U.S. Pat. No. 6,188,859.

Referring to FIGS. from 2 through 4, a developer-replenishing container is shown comprising a cylindrical container body 1 holding a developer 5, and a tubular front extension 2 axially forwardly extended from the cylindrical container body 1 and terminating in a front bottleneck 20 for output of the developer 5. The tubular front extension 2 has a smaller diameter than the container body 1, and a tapered front side 10 terminating in the front bottleneck 20. The container body 1 comprises two longitudinal series of smooth developer guide wall portions 11;11' symmetrically disposed at two sides, and a plurality of oblique developer guide wall portions 12 respectively connected between the smooth developer guide wall portions 11;11'. The oblique developer guide wall portions 12 include a first oblique developer guide wall portion 13 extending to the tubular front extension 2. The longitudinal series of smooth developer guide wall portions 11;11' each include a first smooth developer guide wall portion 14 having a tapered front section 15 connected to the front bottleneck 2. The tubular front extension 2 comprises a rear sloping developer guide wall portion 21 connected to the tapered front section 15 of the first smooth developer guide wall portion 14 of the container body 1, a plurality of smooth developer guide wall portions 22 and oblique developer guide wall portions 23 alternatively connected between the rear sloping developer guide wall portion 21 and the front bottleneck 20. The tubular front extension 2 preferably has a tapered front side terminating in the front bottleneck 20. The container body 1 further comprises an internal guide flange 3 spirally extended around the inside wall thereof between each two axially spaced smooth developer guide wall portions 22. A retaining structure 4 is provided outside the front bottleneck 20. The retaining structure 4 can be ratchet means, retaining block means, retaining plate means, or any suitable retaining means for enabling the developer-replenishing container to be positioned in an electrophotographic image forming apparatus. By means of the aforesaid design, the developer 5 can be smoothly efficiently guided out of the developer-replenishing container upon rotation of the developer-replenishing container by a rotary transmission mechanism in the electrophotographic image forming apparatus.

As indicated above, the arrangement of the smooth developer guide wall portions 11;11' and oblique developer guide wall portions 12 of the container body 1 enables the developer 5 to be smoothly and evenly guided out of the front bottleneck 20 to the electrophotographic image forming apparatus, preventing blocking of the developer 5 due to laminar flow or bridging effect.

Figure 2:
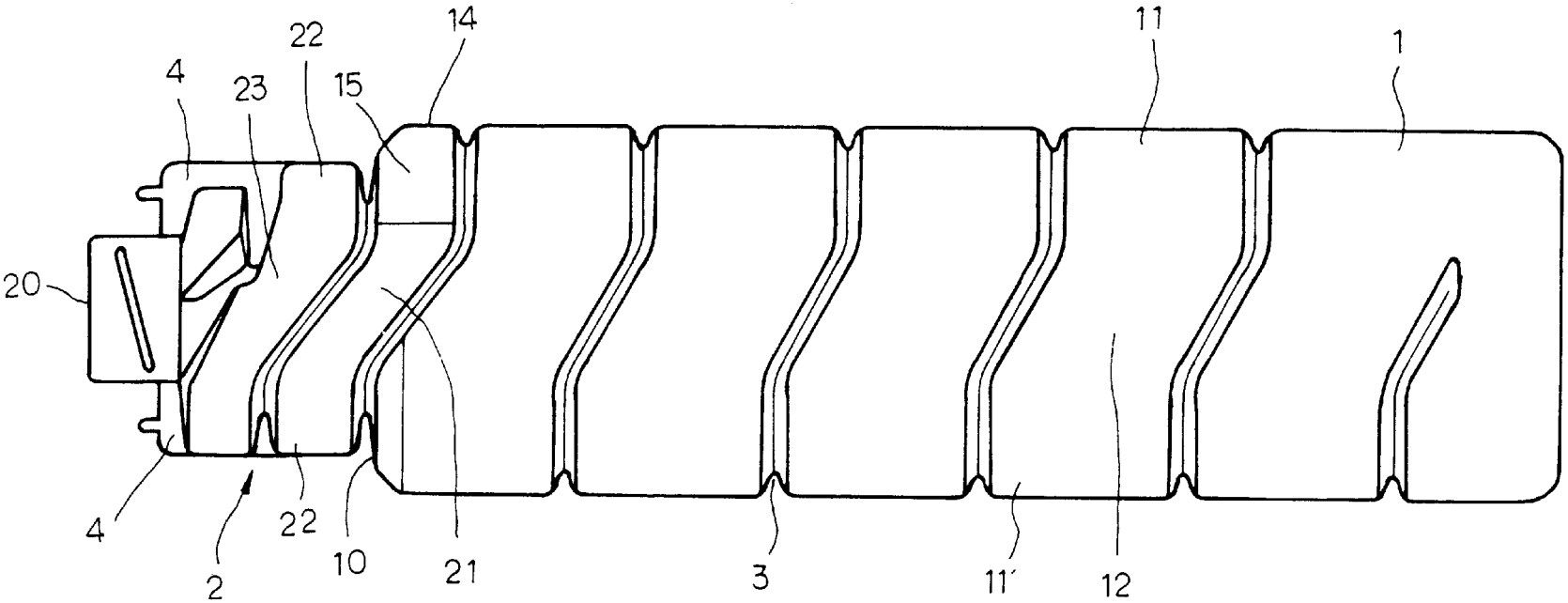
FIG 2 is a front side view of a developer-replenishing container according to the present invention.
Figure 3:
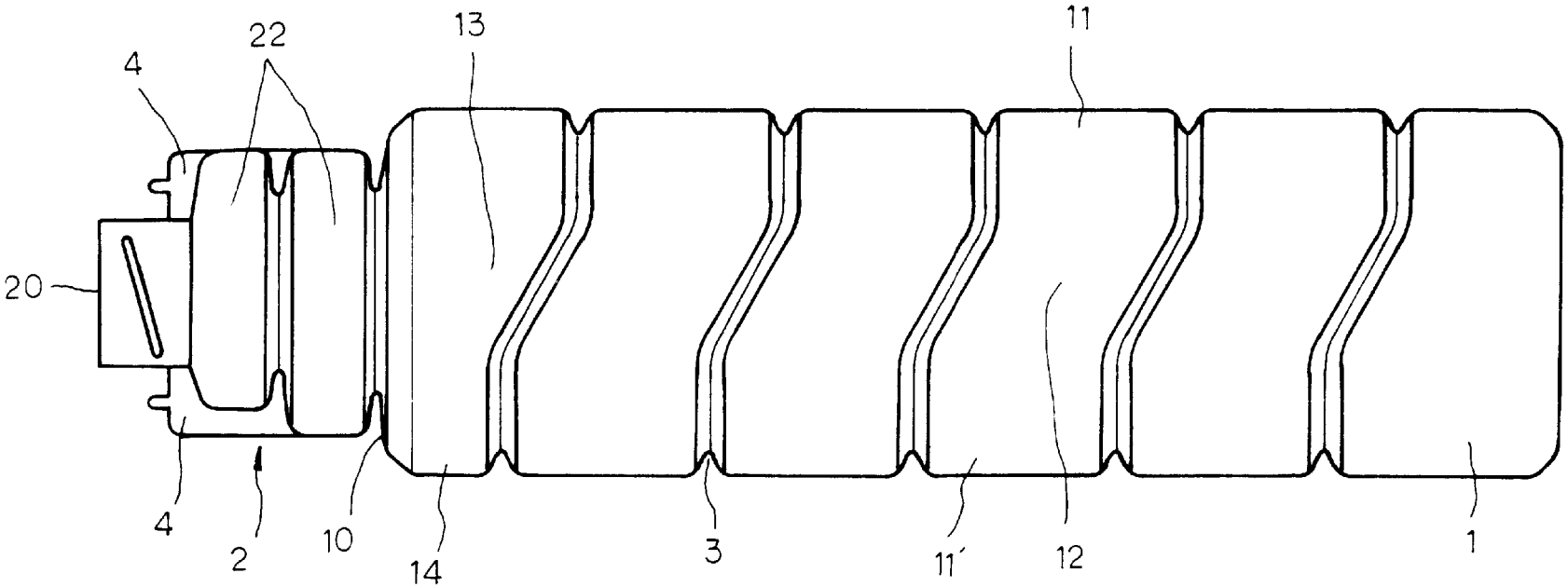
FIG. 3 is a backside view of the developer-replenishing container according to the present invention.
Figure 4:
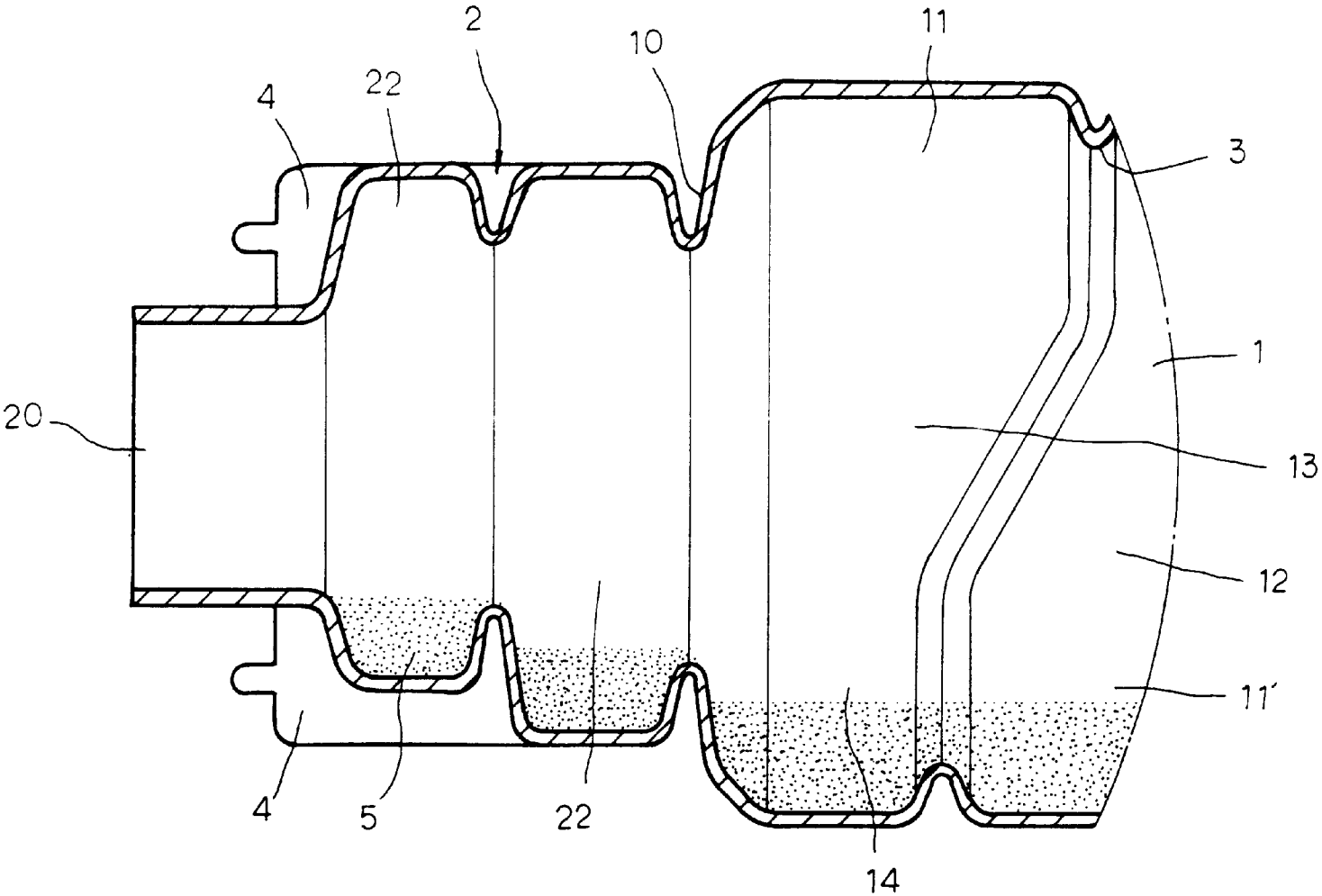
FIG. 4 is a sectional view in an enlarged scale of the front part of the developer-replenishing container according to the present invention.

A prototype of developer-replenishing container has been constructed with the features of FIGS. 2~4. The developer-replenishing container functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A developer-replenishing container comprising a cylindrical container body holding a developer and a tubular front extension axially forwardly extended from said cylindrical container body and terminating in a front bottleneck for output of said developer, said container body comprising longitudinal series of smooth developer guide wall portions symmetrically disposed at two sides and a plurality of oblique developer guide wall portions respectively connected between the smooth developer guide wall portions of said cylindrical container body and adapted to guide said developer from said cylindrical container body to said tubular front extension, said tubular front extension comprising smooth developer guide wall portions symmetrically disposed at two sides and a plurality of oblique developer guide wall portions respectively connected between the smooth developer guide wall portions of said tubular front extension and adapted to guide said developer from said container body toward said front-bottleneck.

2. The developer-replenishing container of claim 1 wherein said container body comprises a tapered front section extending from one smooth developer guide wall portion thereof, and said tubular front extension comprises a rear sloping developer guide wall portion extending from the tapered front section of said container body to one smooth developer guide wall portion thereof.

3. The developer-replenishing container of claim 1 wherein said container body further comprises an internal guide flange spirally extended around an inside wall thereof between each two smooth developer guide wall portions of said container body.

4. The developer-replenishing container of claim 1 wherein the smooth developer guide wall portions and oblique developer guide wall portions of said container body and the smooth developer guide wall portions and oblique developer guide wall portions of said tubular front extension are spirally connected in series and adapted to guide said developer toward said front bottleneck.

5. The developer-replenishing container of claim 1 wherein said tubular front extension has a tapered front section connected between one smooth developer guide wall portion of said tubular front extension and said front bottleneck.

6. The developer-replenishing container of claim 1 further comprising retaining means disposed outside said front bottleneck and adapted to secure the developer-replenishing container to an electrophotographic image forming apparatus.

7. The developer-replenishing container of claim 1 wherein said developer-replenishing container comprises a retaining ratchet device.

8. A developer-replenishing container comprising a cylindrical container body holding a developer and a tubular front extension axially forwardly extended from said cylindrical container body and terminating in a front bottleneck for output of said developer, said container body comprising longitudinal series of smooth developer guide wall portions symmetrically disposed at two sides, a plurality of oblique developer guide wall portions respectively connected between the smooth developer guide wall portions of said cylindrical container body, and a tapered front section extending from one smooth developer guide wall portion thereof and adapted to guide said developer from said cylindrical container body to said tubular front extension, said tubular front extension comprising a rear sloping developer guide wall portion extending from the tapered front section of said container body, smooth developer guide wall portions symmetrically disposed at two sides, and forwardly extending from said rear sloping developer guide wall portion, and a plurality of oblique developer guide wall portions respectively connected between the smooth developer guide wall portions of said tubular front extension and adapted to guide said developer from said container body toward said front bottleneck.

9. The developer-replenishing container of claim 8 wherein said tubular front extension has a tapered front section connected between one smooth developer guide wall portion of said tubular front extension and said front bottleneck.

10. The developer-replenishing container of claim 8 wherein said container body further comprises an internal guide flange spirally extended around an inside wall thereof between each two smooth developer guide wall portions of said container body.

11. The developer-replenishing container of claim 8 further comprising retaining means disposed outside said front bottleneck and adapted to secure the developer-replenishing container to an electrophotographic image forming apparatus.

12. The developer-replenishing container of claim 11 wherein said retaining means comprises a retaining ratchet device.

* * * * *